US006227808B1

(12) United States Patent
McDonough

(10) Patent No.: US 6,227,808 B1
(45) Date of Patent: May 8, 2001

(54) SPA PRESSURE SENSING SYSTEM CAPABLE OF ENTRAPMENT DETECTION

(75) Inventor: William B. McDonough, Huntington Beach, CA (US)

(73) Assignee: Hydroair a Unit of ITT Industries, Orange, CA (US)

( * ) Notice: Subject to any disclaimer, the term of this patent is extended or adjusted under 35 U.S.C. 154(b) by 0 days.

(21) Appl. No.: 09/354,932

(22) Filed: Jul. 15, 1999

(51) Int. Cl.[7] ..... F04B 49/06
(52) U.S. Cl. ..... 417/44.2; 210/86
(58) Field of Search ..... 4/493, 541.1; 210/472, 210/86; 310/339; 250/227.22; 219/497; 359/193; 417/44.2, 44.9; 62/238.6

(56) References Cited

U.S. PATENT DOCUMENTS 3,781,925 * 1/1974 Curtis et al. ..... 4/493
4,322,297 * 3/1982 Bajka ..... 210/742
5,332,944 * 7/1994 Cline ..... 310/339
5,410,150 * 4/1995 Toron et al. ..... 250/227.22
5,585,025 * 12/1996 Idland ..... 219/497
5,602,670 * 2/1997 Keegan ..... 359/193
5,690,476 * 11/1997 Miller ..... 417/44.2
5,725,359 * 3/1998 Dongo et al. ..... 417/44.9
5,730,861 * 3/1998 Sterghos et al. ..... 210/86
5,809,796 * 9/1998 Zakryk ..... 62/238.6
5,898,958 * 5/1999 Hall ..... 4/541.1
6,003,166 * 12/1999 Hald et al. ..... 4/541.1
6,059,536 * 5/2000 Stingl ..... 417/44.2

* cited by examiner

*Primary Examiner*—Teresa Walberg
*Assistant Examiner*—Leonid Fastovsky
(74) *Attorney, Agent, or Firm*—Knobbe, Martens Olson & Bear LLP

(57) ABSTRACT

A control circuit for use with a spa system includes a pressure sensor which generates a signal representative of the pressure in the system. A microcontroller is coupled to receive the signal from the sensor and is configured to store a first pressure level. The microprocessor compares the first pressure level with the subsequently measured pressure level and generates a control signal if the comparison indicates a change in pressure which exceeds a predetermined amount. An electronically controlled switch is coupled to receive the control signal from the microcontroller and turn electrical power to the pump off in response thereto.

18 Claims, 12 Drawing Sheets

SPA PRESSURE SENSING SYSTEM CAPABLE OF ENTRAPMENT DETECTION

BACKGROUND OF THE INVENTION

1. Field of the Invention

This invention generally relates to spas and hot tubs and more specifically to control systems and circuits utilized in such spas and hot tubs.

2. Description of the Related Art

Pools, whirlpool spas, hot tubs and related systems typically include a tub for holding water, a pump for circulating the water and a heater. The pump draws water from the tub through a drain, forces the water through the heater and out through jets into the tub, thereby circulating the water and causing it to be heated by passing it through the heater.

When the pump is operating, personal contact with the drain can be dangerous, painful or even fatal. When the body or hair of a person is positioned in close proximity to the drain, the body or hair may completely or partially block the drain, thereby creating a vacuum or entrapment. This can cause entrapment of the person. Many pumps used in such systems, if obstructed, can draw a partial vacuum at the drain that may exert sufficient suction force to prevent a person from pulling free of the drain. Even if the person can pull free of the drain, bruises, welts, or other damage may result.

One approach to overcoming this safety hazard has been the use of multiple drains or suction ports and suction covers or grates which are formed to minimize the possibility of hair entanglement and prevent an airtight seal between a person's body and the drain. However, there are many systems still in use that were installed prior to the recognition of this safety hazard. It can be extremely difficult and expensive to rebuild or retrofit such existing systems to conform to modem safety regulations. Mechanical systems such as vacuum breakers and a Stengil switch can be retrofitted into such systems to give some measure of protection. However, such systems are not particularly sensitive to partial conditions of entrapment such as hair entanglement.

In addition, it is the current trend in safety regulations to require that such systems have a flow sensor. One use of flow sensors is to insure that water is flowing through the system and the heater before the heater is activated. Such flow sensors have typically been implemented as an electromechanical flow switch consisting of a microswitch activated by a diaphragm in contact with the water. These pressure switches are usually set to an arbitrarily low value, which may be 10 to 20 percent of the actual full pressure of the system in normal operation. Exceeding this low value is used as an indication that the pump is working. However, it is insufficient to detect significant pressure changes such as would be caused by partial entrapment.

SUMMARY OF THE INVENTION

The present invention provides a control circuit which can automatically remove electrical power from a device such as a pump in response to an indication of a change in the pressure caused by the pump.

The control circuit controls the application of electrical current to the pump. A sensor generates a signal representative of the pressure generated by the pump. A microcontroller is coupled to receive the signal from the sensor and configured to store a first level indicative of a signal received from the sensor at a first time. The microcontroller is configured to compare the first level with a second level indicative of a signal received from the sensor at a second time. The microcontroller is configured to generate a control signal when the comparison between the two levels indicates a change in pressure which exceeds a predetermined amount of change. An electrically controlled switch is coupled to receive the control signal from the microcontroller and is configured to control application of electrical power to a device, such as a pump, in response to the control signal.

In one aspect of the invention the sensor is a pressure sensor which is capable of producing a signal representative of changes in pressure in the spa system. The control circuit can be used to detect conditions of entrapment or partial entrapment and immediately shut off the pump in the spa when such conditions are detected.

In another aspect of the invention the control circuit and the sensor can also be used as a flow detector for detecting the flow of water through the spa system. The detection of water flowing in the system can then be used as part of the control of the spa system, for example, only allowing a heater associated with the spa to be turned on when water is flowing.

These and other features and advantages of the invention will be readily apparent to those skilled in the art from the following detailed description of embodiments of the invention with reference to the accompanying drawings.

DETAILED DESCRIPTION OF THE PREFERRED EMBODIMENT

The invention provides a pressure or vacuum sensor and an associated control circuit, which can be used for a tub or spa, or similar systems, which use a pump to circulate water. Spas, hot tubs, pools and similar systems are generally referred to herein as spas. The control system can implement the normal functions required of a modern digital spa or pool control including pump control, water flow detection and heat control. In addition to these known control functions, the system also rapidly detects conditions that are indicative of entrapment brought about by a person being trapped or partially trapped against the suction of the pump. When the system detects entrapment, the pump is immediately shut off.

Figure 1:
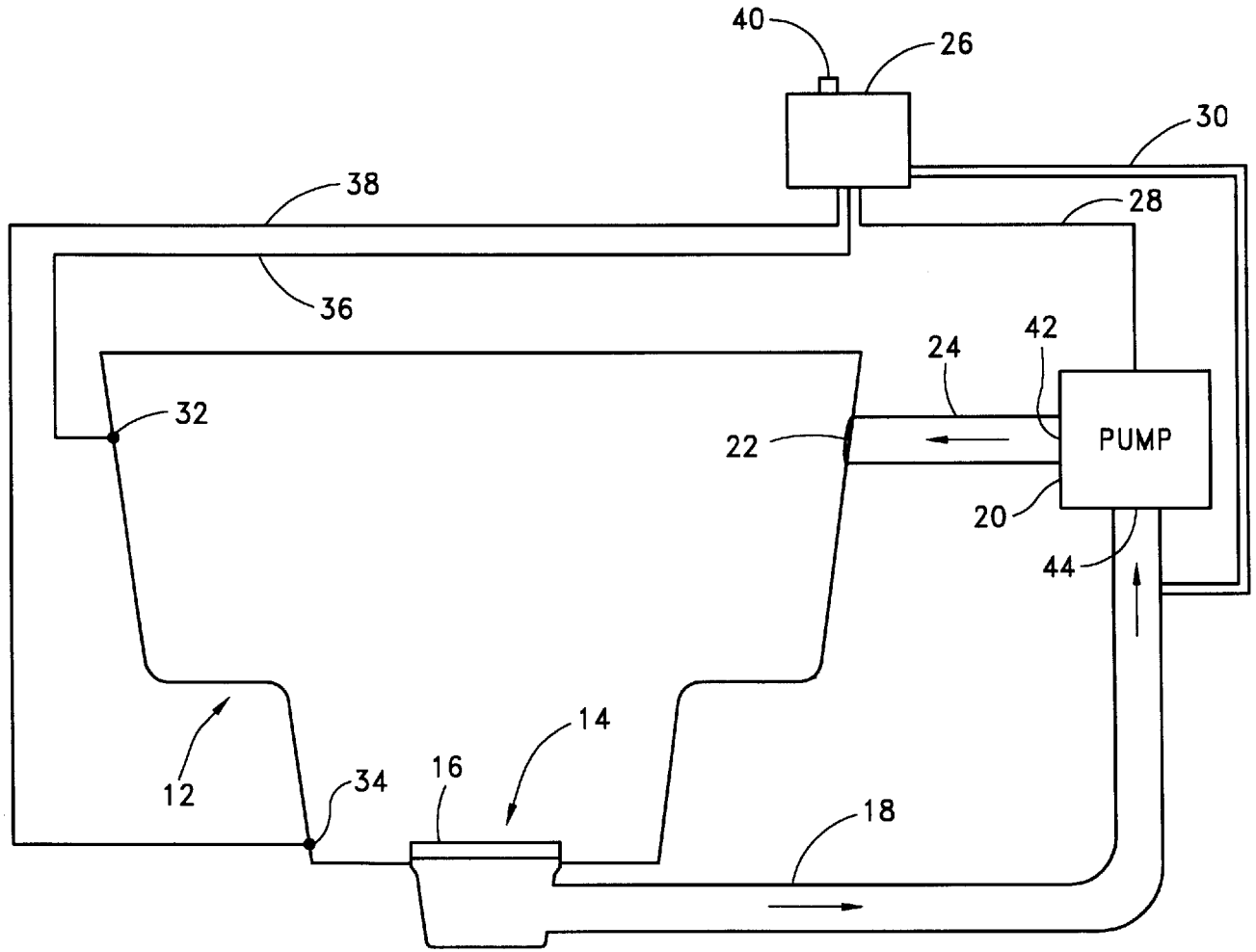
FIG. 1 is a block diagram of a spa employing the invention.

Referring to FIG. 1, the overall configuration of a spa utilizing the present invention will be described. The spa includes a tub 12, having at its bottom a drain 14. A suction cover 16 covers the drain 14. A return pipe 18 couples the drain 14 of the tub 12 to the input of a pump 20. The output of the pump 20 is coupled to a return jet 22 via an exhaust pipe 24. The circulating system of the spa of includes the return pipe 18, the pump 20 and the exhaust pipe 24. A single jet 22 is shown for ease of description, though most spas employ multiple jets. Similarly, some spas also employ multiple drains.

A control circuit 26 provides electrical power to the pump via electrical line 28. The control circuit 26 receives its electrical power from an alternating current source, such as a typical wall outlet (not shown). A hollow coupling line 30 in fluid communication with the return pipe 18 transmits the pressure in the pipe 18, and changes in the pressure, to a pressure transducer or sensor located in the control circuit 26. Alternatively, the coupling line 30 can be used in fluid communication with the exhaust pipe 24 and thereby transmit the pressure in that pipe. Either approach allows the pressure transducer to monitor pressure generated by the pump. Alternatively, different measurements or indications which relate to or can be correlated with the pressure generated by the pump can be used. For example, the amount of current drawn or power factor (the phase angle between the voltage and the current) by the pump can be monitored or measured by a sensor. Changes in the current flow as indicated by comparing two or more measurements separated in time can then be used as the criteria for determining when to turn the pump off. Similarly, the speed of the pump can be monitored or measured by a sensor and changes in the pump's speed as indicated by comparing two or more measurements separated in time can then be used as the criteria for determining when to turn the pump off. Also, a sensor in the form of a flow meter or other device which produces a signal representative of the flow of water through the spa system could be substituted for the pressure sensor transducer.

The control circuit 26 and the pressure transducer are electrically isolated from the water in the pipe 18 by a flexible seal. The flexible seal can be located at either end of line 30, or at some point, along line 30. In that manner, the pressure present in pipe 18 can be remotely sensed by the control circuit 26. In addition, the coupling line 30 can contain a column of air, which further insulates and separates the pressure transducer from the water of the spa. This arrangement can extend the useful life of the pressure transducer, which can be harmed through prolonged contact with the water in the spa.

Conductive elements 32 and 34 pass through the wall 15 of the tub 12 and are electrically coupled to the control circuit 26 by electrically conductive lines 36 and 38 respectively. The conductive elements 32 and 34 can be stainless steel screws, copper rivets, or other electrically conductive materials. The conductive elements 32 and 34 are exposed to water within tub 12 when it is full, thereby allowing the control circuit to sense whether the water level of the tub is above a predetermined level as will be discussed further below.

When the pump 20 is operating, water is drawn in through the drain 14, travels through the return pipe 18 where it enters the pump 20. The pump 20 pushes the water through the exhaust pipe 24 and out through the jet 22 back into the tub 12. In addition, the spa may include a heater, electrical lights and other enhancements known to those of skill in the art. Those elements are not represented in FIG. 1 for ease of description.

The control circuit 26 controls the application of electrical power to the pump 20. An on/off switch 40 can be activated by a user to turn the pump on. Before providing electrical power to the pump 20, the control circuit 26 first determines if the water level in the tub is sufficiently high to cover the jet 22. The water level is detected utilizing the conductive elements 32, 34. The first conductive element 32 is typically located slightly above the level of the jet. The second conductive element 34 is located at a lower level, typically adjacent to the bottom of the tub. The control circuit 26 applies a relatively high frequency signal to one of the conductive elements. If water is present between the two conductive elements, it will transmit the high frequency signal, which can then be detected at the other conductive element. The detection of the signal indicates that a sufficient amount of water is present for proper operation of the system.

After water is detected in the tub, the control circuit 26 applies electrical power to the pump 20. The pump then begins pushing water through the system which increases the water pressure on the outlet side 42 of the pump 20 at the same time decreasing the pressure (increasing the vacuum level) on the inlet side 44 of the pump. After a suitable delay, for example, two seconds, the control circuit 26 senses the pressure on the inlet side of the pump 20 via line 30. The control circuit stores that value to be used as a baseline for future reference. Detecting and storing this first or initial pressure value allows the system to be self-calibrating upon start-up.

During normal operation, the control circuit 26 checks the vacuum at the input side of the pump 20 very frequently, for example, dozens of times per second. The sensed pressure is compared against the baseline originally acquired and stored. If a decrease in pressure of more than a predetermined amount from the baseline occurs for example, 20%, and lasts for more than a predetermined time, for example, 0.1 seconds, the control circuit 26 shuts off power to the pump. Alternatively, any two or more measurements or indications of the pressure separated in time can be compared to determine whether there has been a change in pressure. If the change in pressure exceeds a predetermined amount, the control circuit 26 shuts off power to the pump. Of course, one skilled in the art could assemble numerous variations of specific circuits to carry out these functions.

Figure 2:
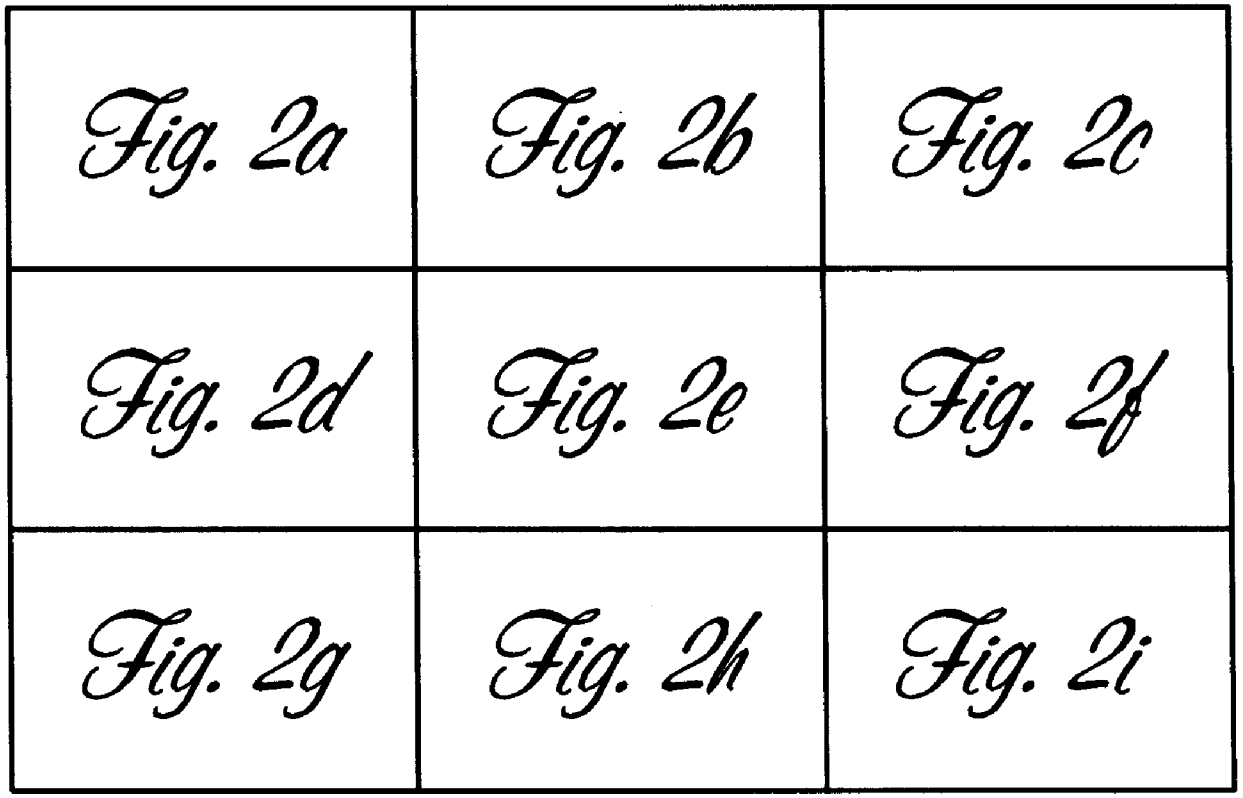
FIG. 2 is a detailed circuit diagram of a circuit embodying aspects of the invention.
Figure 2A:
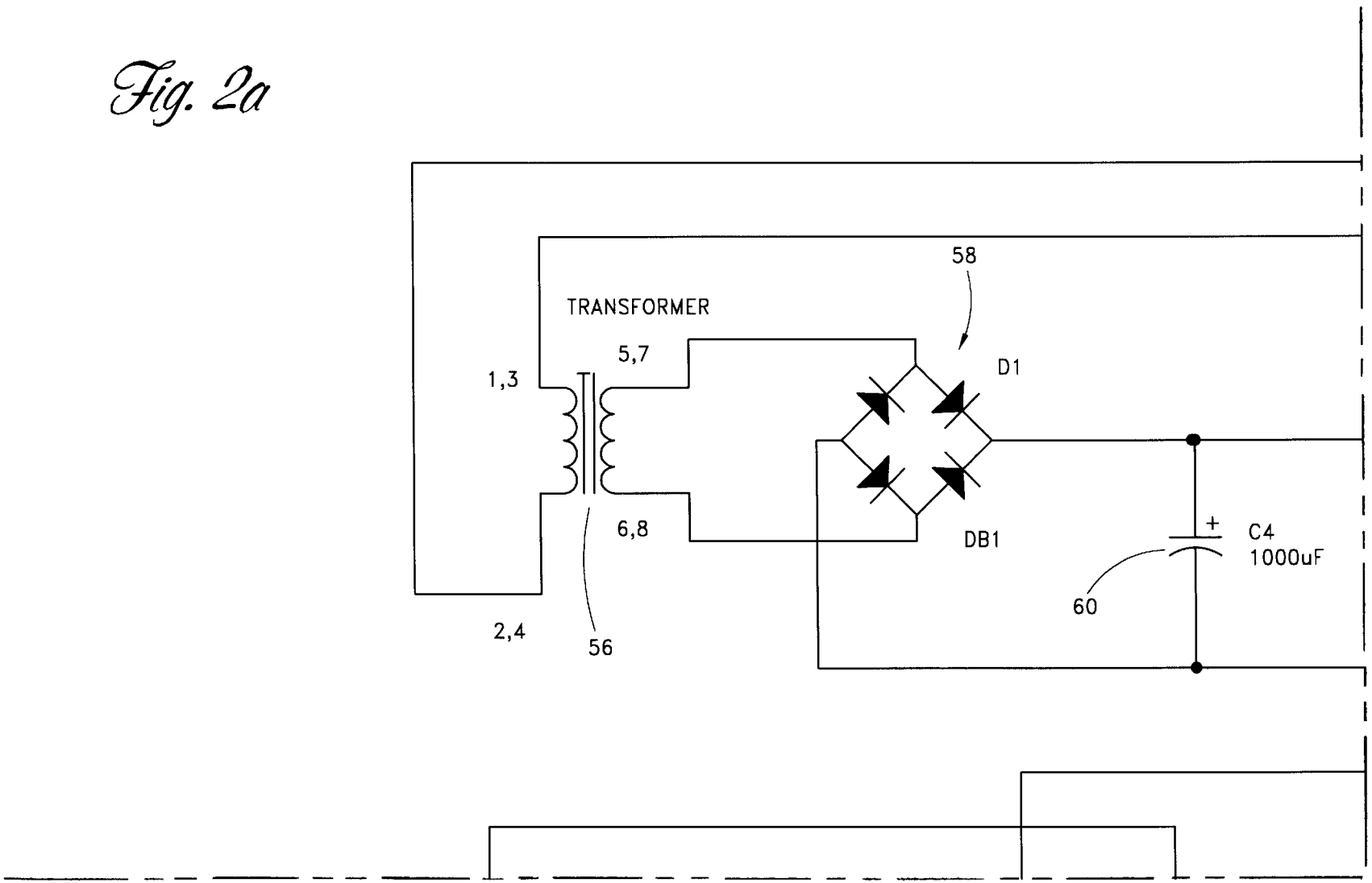
Figure 2B:
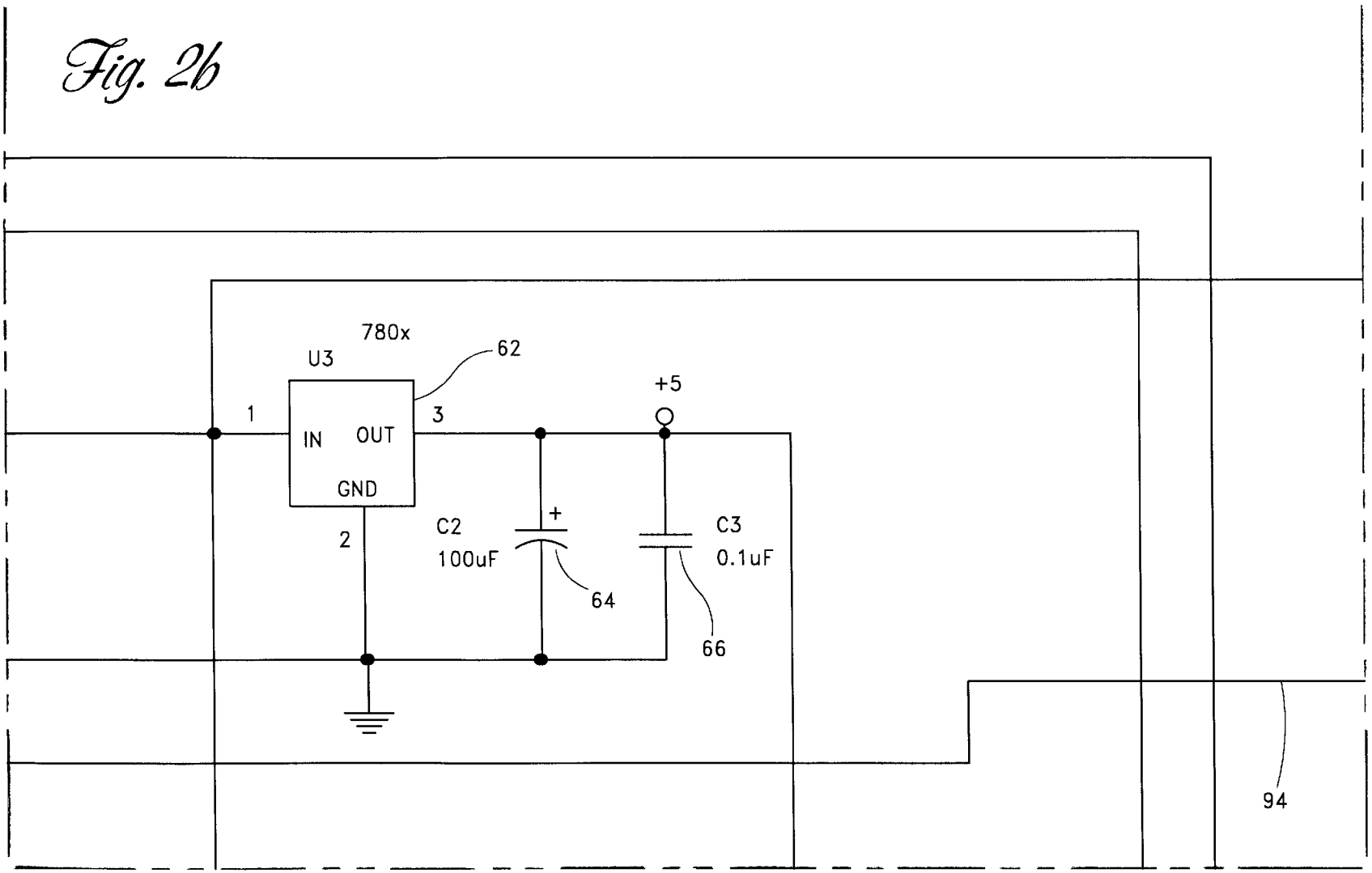
Figure 2C:
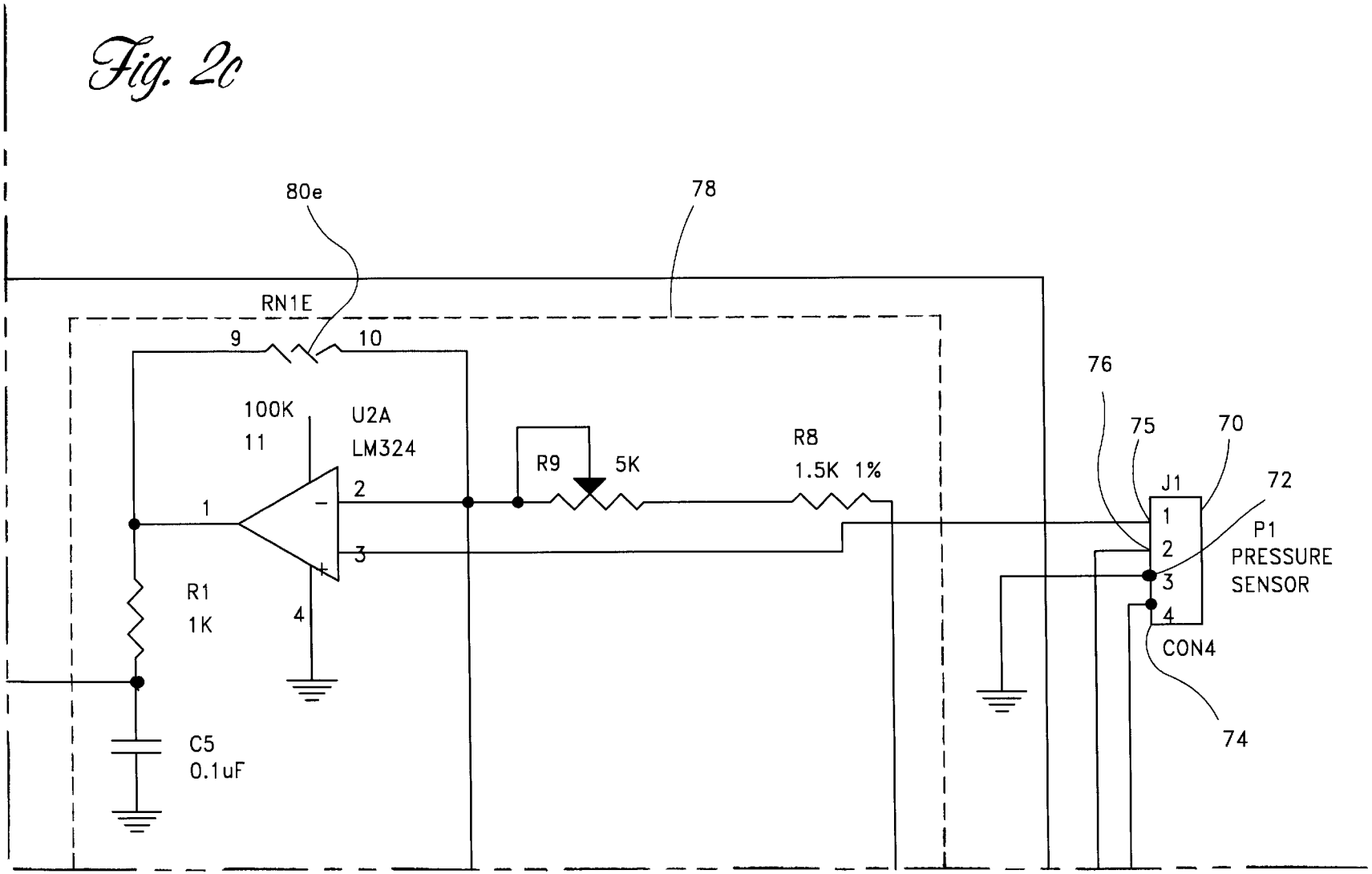
Figure 2D:
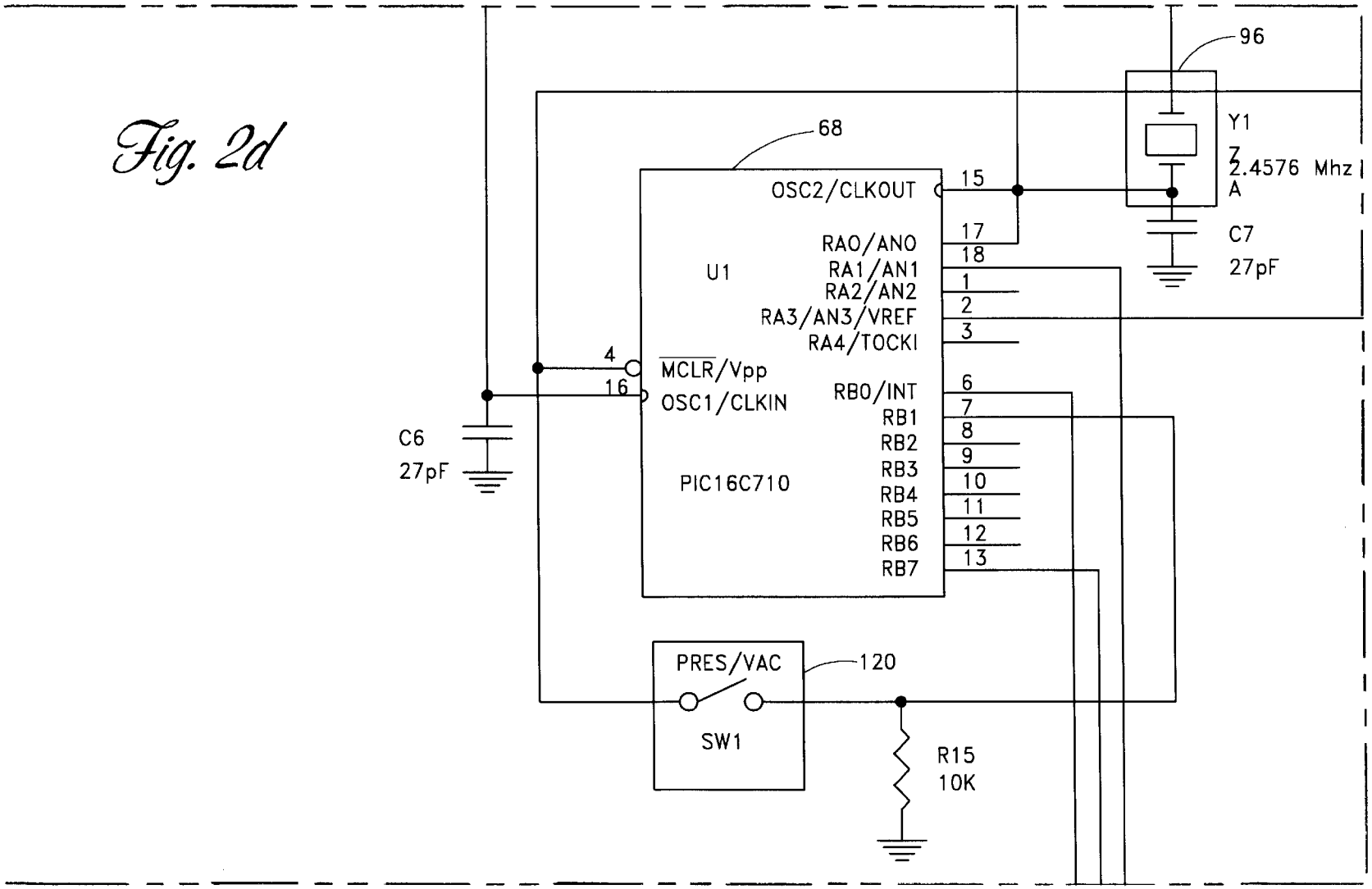
Figure 2E:
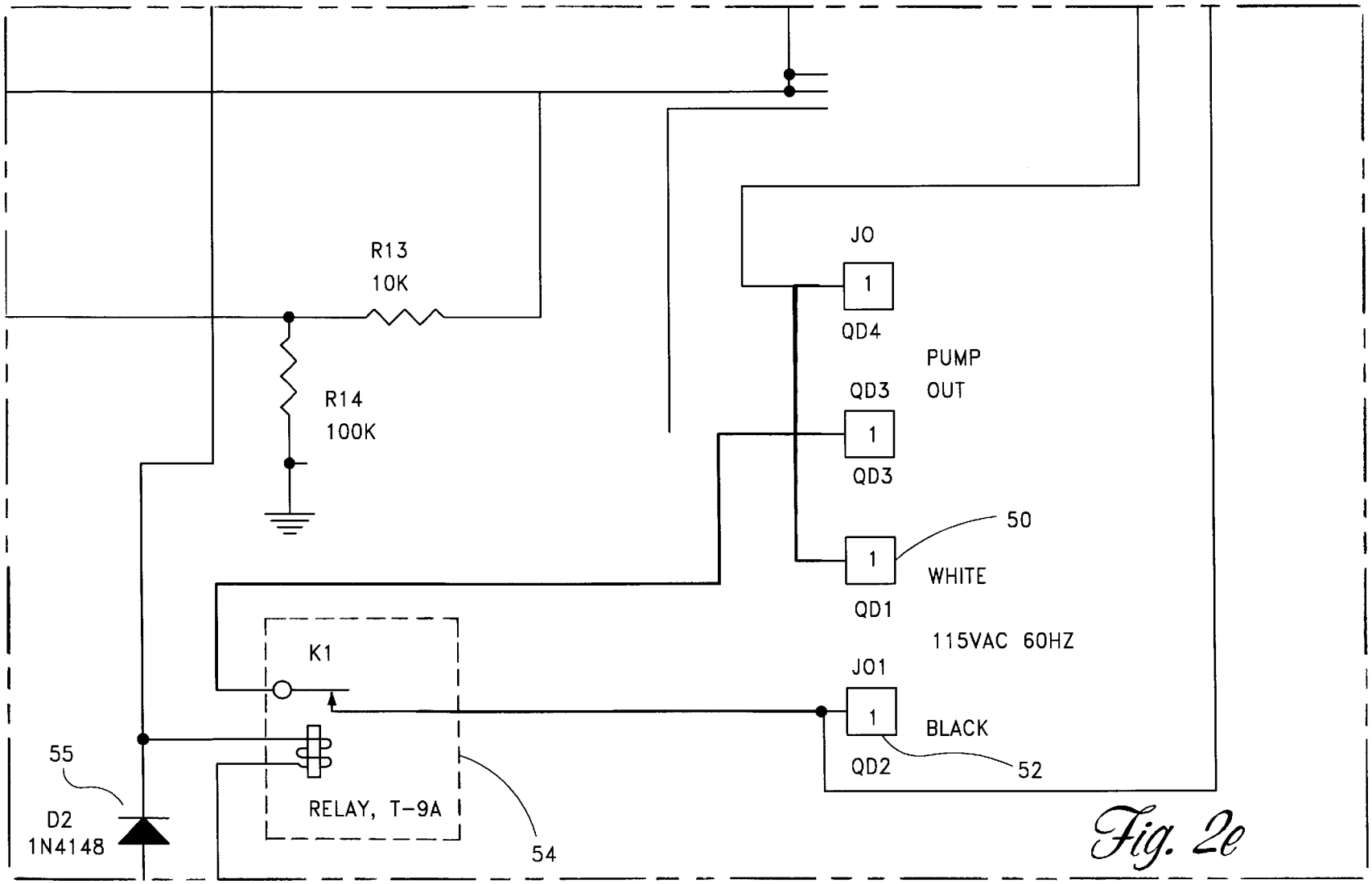
Figure 2F:
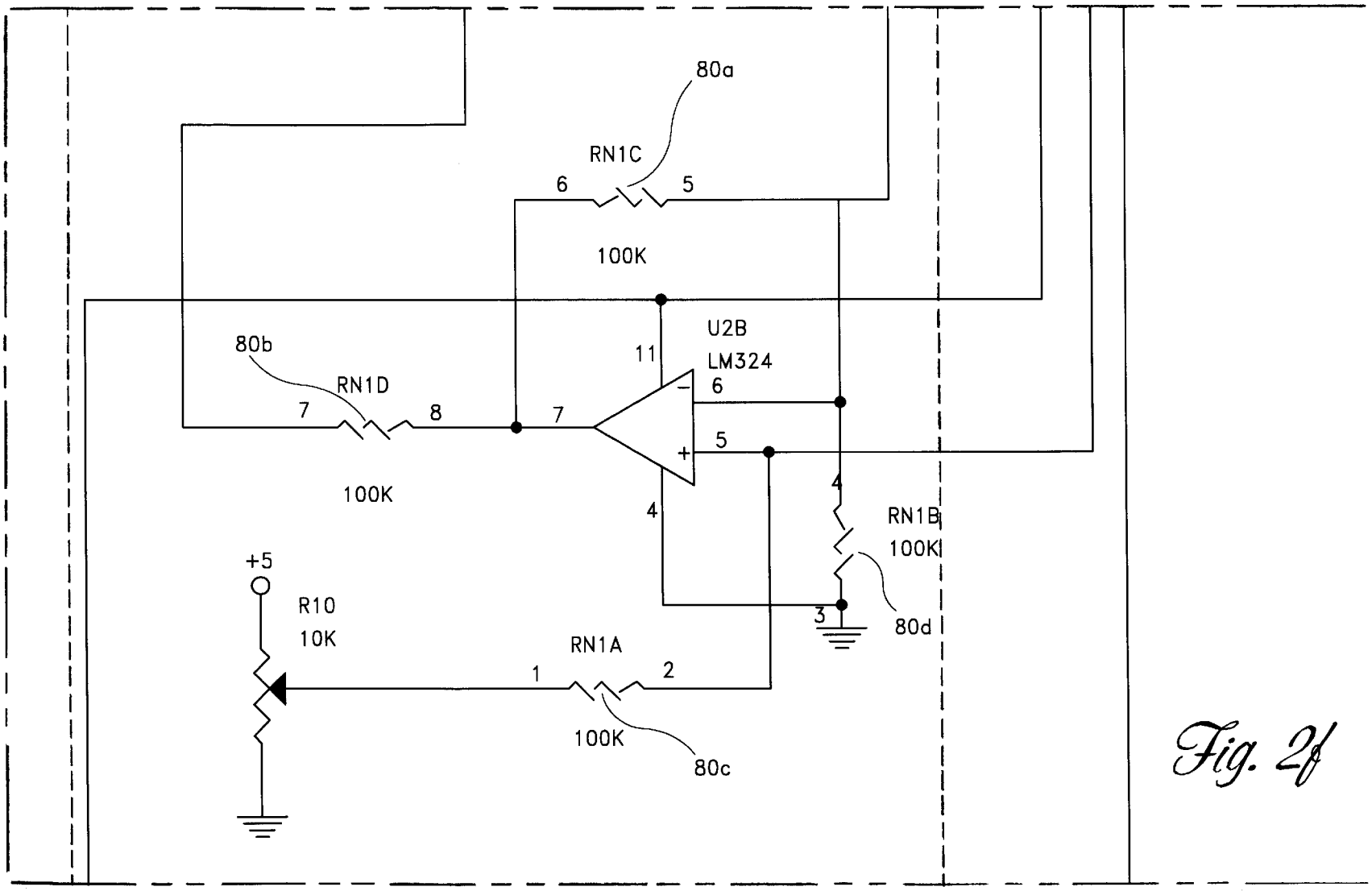
Figure 2G:
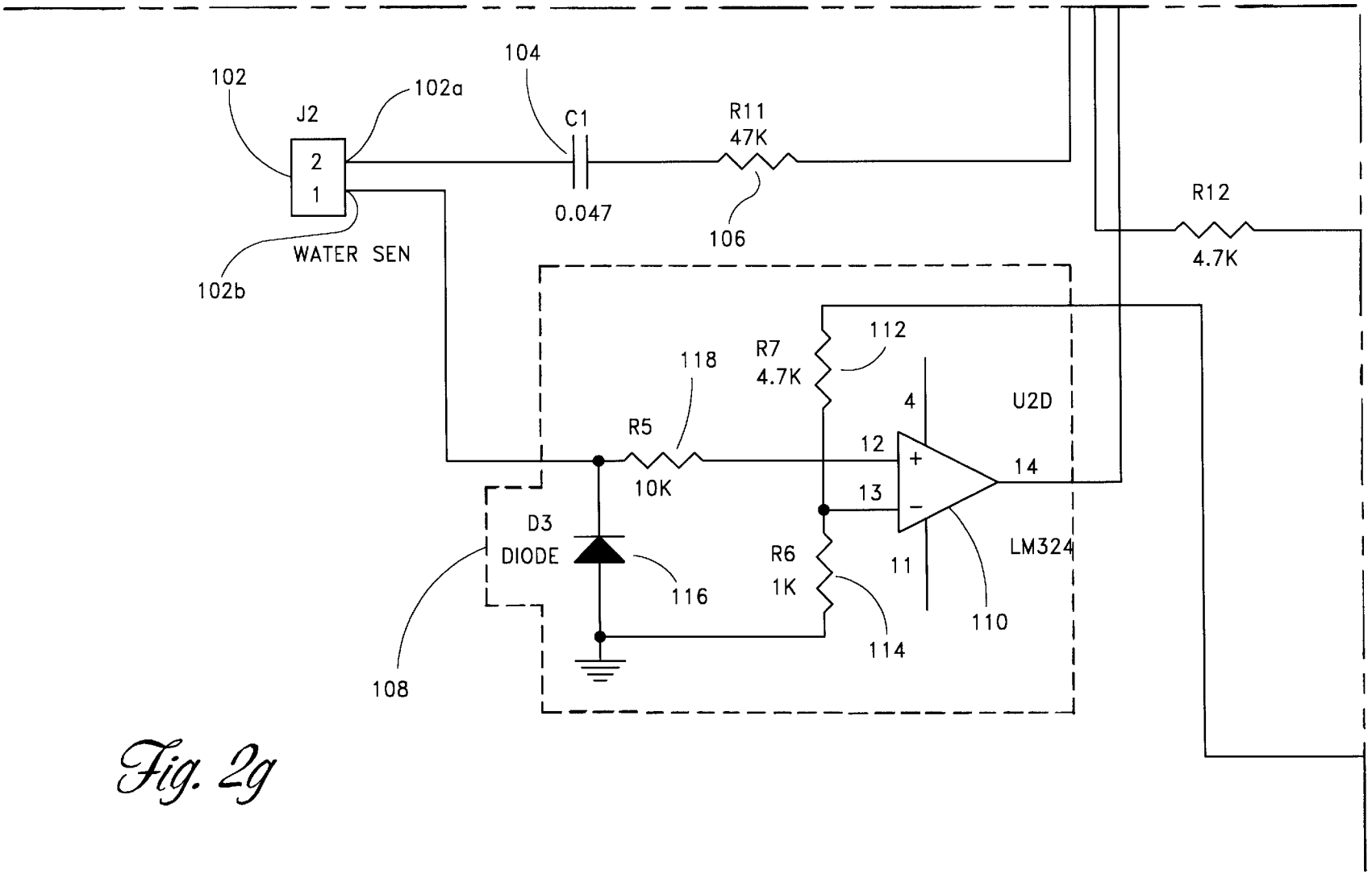
Figure 2H:
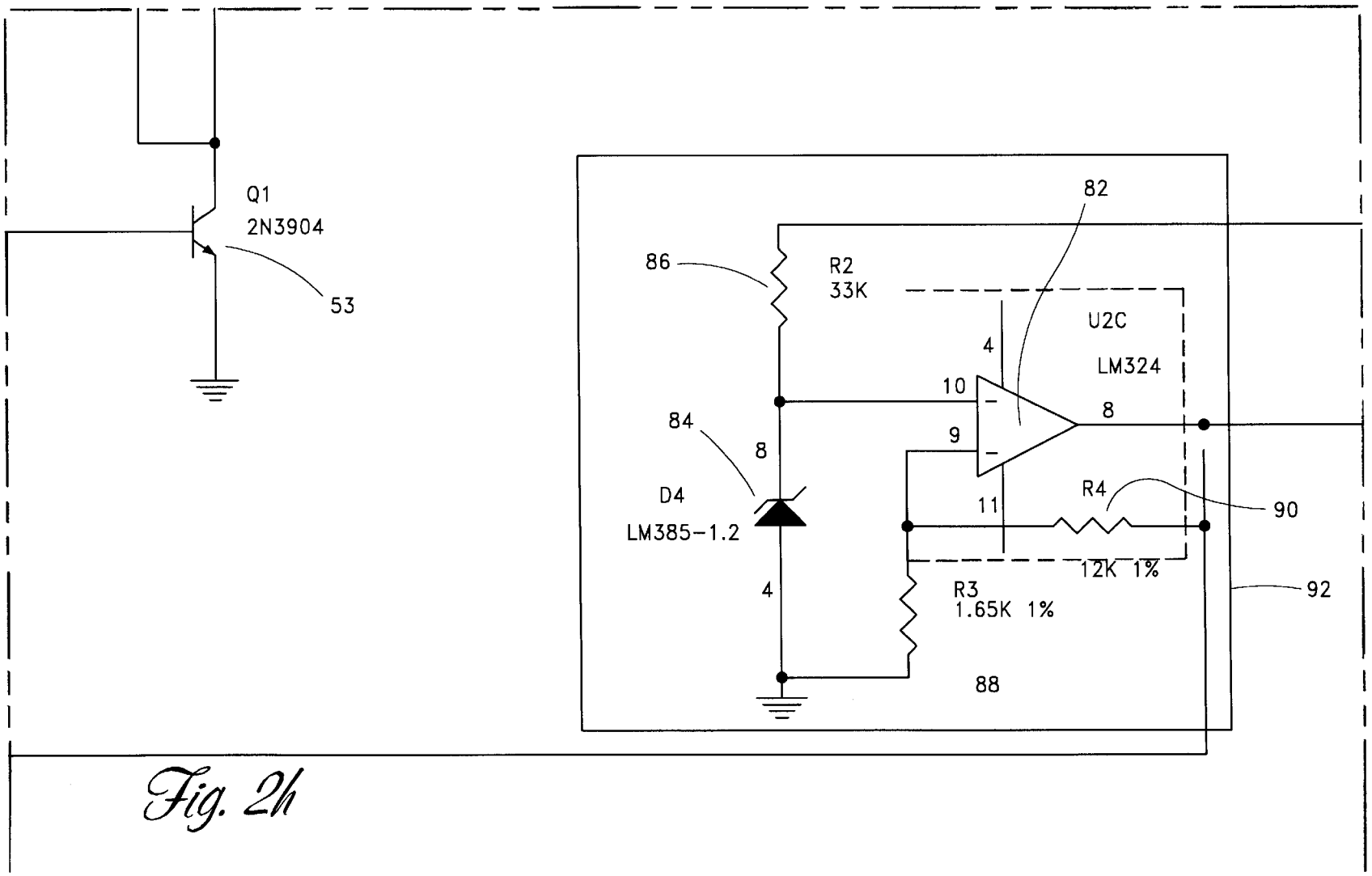
Figure 2I:
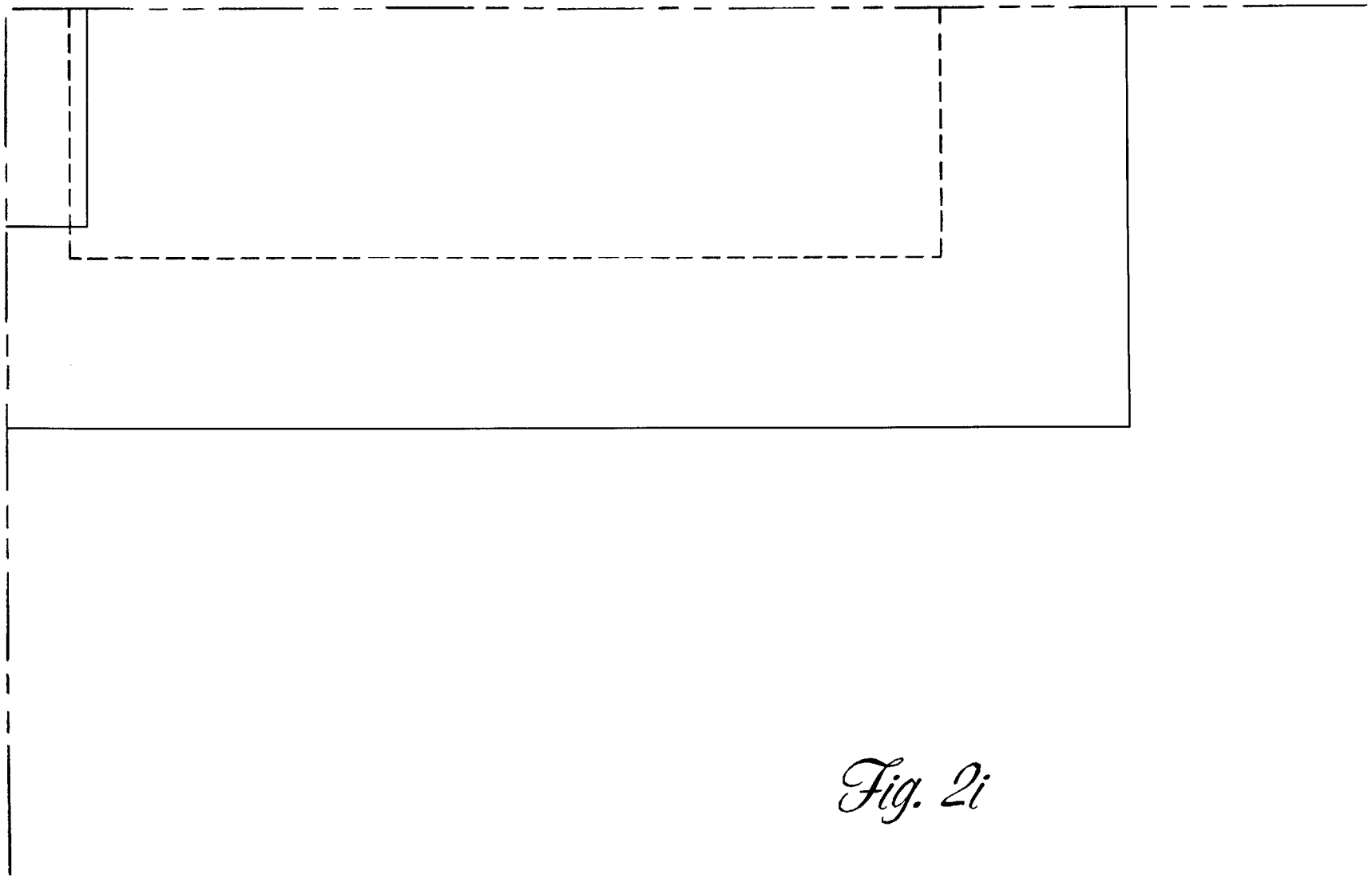

FIG. 2 is a schematic depiction of an embodiment of the control circuit 26. An input voltage, typically 115 volts-AC is applied across input terminals 50 and 52. The input terminal 50 is directly coupled to the pump 28 (see FIG. 1) while the input terminal 52 is in series with a normally open relay 54 which is also in series with the pump 20. The relay 54 operates as a switch mechanism and when closed completes the circuit which applies electrical power to the pump 20.

The input terminals 50, 52 are also coupled to a transformer 56. The transformer 56 is coupled with a diode bridge 58 which forms a bridge rectifier. The transformer 56 and the diode bridge 58 cooperate to produce approximately 15 volts/DC across a capacitor (C4) 60, which can have a capacitance of 1,000 micro-farads. The capacitor 60 (C4) operates as a filter capacitor for the 115 volts-AC input voltage. The voltage output by the bridge rectifier 58 is also applied to a voltage regulator integrated circuit 62. The voltage regulator 62 produces a constant, regulated 5 volt/DC output appropriate for use with the other integrated circuits which form part of the control circuit and are described below. A capacitor (C2) 64, and a second capacitor (C3) 66, cooperate with the voltage regulator 62 in providing a well-regulated 5-volt DC output. The capacitance of the capacitors can be 100 micro-farads and 0.1 micro-farads respectively.

The 5-volt DC power is then supplied to a microcontroller 68. An oscillator 96, which can be a 2.4576 Mhz oscillator, provides a regulated oscillating input to the microcontroller 68 for timing purposes. The microcontroller can be a microcontroller model PIC 16C710 8-byte microcontroller from Microchip Technology, Inc. or any other suitable commercially available microcontroller or microprocessor.

A pressure transducer or sensor 70 is coupled to line 30 (FIG. 1). Line 30 can be a ¼ inch flexible PVC tubing which is mounted on a barb on pipe 18. In one embodiment, line 30 is filled with air. Using air can provide the advantage of keeping the pressure transducer or sensor 70 out of contact with the water of the spa. Pressure sensor 70 can be a conventional strain/gage bridge device implemented with piezo resistive material. The output of the pressure sensor is a differential resistance change that is approximately linearly proportional to the pressure force (or vacuum force) of the air column (or water column) applied to it. Such devices are available from manufacturers such as Honeywell, Motorola, and Lucas. For example, Honeywell manufacturers such a sensor identified as model 22PC. Alternatively, a pressure sensor device which produces an electrical output representative of pressure and/or changes in pressure can also be used.

A constant voltage is applied across two inputs 72, 74 of the pressure sensor. The differential voltage is then present across two outputs 75, 76 of the pressure sensor 70. The differential voltage across the outputs 75, 76 of the pressure sensor 70 are supplied to an instrumentation differential amplifier 78. An output signal 94 from the differential amplifier 78 is supplied to the microcontroller 68. A capacitor (CS) which can have a value of 0.1 micro-farads. The capacitor (C5) provides filtering to the output of the differential amplifier 78. The gain of the differential amplifier 78 can be approximately 150.

The differential amplifier 78 can be implemented using two of the operational amplifiers of an integrated circuit quad operational amplifier. A quad operational amplifier such as LM 324, which is manufactured by National Semiconductor, among others, can be used for this purpose. Within the differential amplifier 78, the resistor (R10) adjusts the offset of the transducer and can have a resistance of 10,000 ohms.

The variable resistance resistor (R9) adjusts the gain of differential amplifier. The resistors (RN1A–E) 80*a–e* can be from a resistive network with each of the resistors having a resistance of 100,000 ohms. A resistor network is used because the resistor values are matched within 1%, which is required for proper operation of the differential amplifier configuration of the circuit.

An operational amplifier 82 can be a third of the four operational amplifiers of a quad operational amplifier. Operational 82 in cooperation with a Zener diode 84 and the three resistors (R2), (R3) and (R4), 84, 86, and 90 cooperate to form a voltage regulator 92 which provides approximately 10 volts/DC to the input 74 of the pressure sensor 70. Power is supplied to the voltage regulator 92 from the output of the diode bridge 58.

The two conductive elements 32 and 34 are coupled to the microcontroller via the lines 38, 36 (see FIG. 1), which are coupled to a connector 102. A first output 102*a* of the connector 102 is coupled to the microcontroller 68 through a capacitor (C1), which can have a capacitance of 0.047 micro-farads and a resistor (R11) which can have a resistance of 47,000 ohms. The second output 102*b* of the connector 102 is provided to a detector circuit 108 with an output signal which is provided to the microcontroller 68.

As is depicted in FIG. 2, the detector 108 can be in the form of a comparator circuit utilizing an operational amplifier 110, which can be one of the four operational amplifiers from the quad operational amplifier identified above. The regulated voltage from the voltage regulator 92 is provided to one input of the operational amplifier via a resistor (R7) 112. The regulated voltage plus the input from the second input 102*b* of connector 102 is provided to the second input of the operational amplifier 110 via a resistor (R6) 114, a diode (D3) 116 and a resistor (R5) 118. The resistance of the three resistors in the comparator circuit 112, 114 and 118 can be 4,700 ohms, 1,000 ohms and 10,000 ohms respectively.

The microcontroller also provides a control signal to a transistor (Q1) 53. The transistor 53 operates like a switch and allows current to flow when the microcontroller applies a logic high control signal. The transistor (Q1) 53 boosts the relatively low current output of the microcontroller to approximately 0.1 amps to activate the relay. The transistor (Q1) 53 is in series with the coil of the relay 54 and the output of the bridge rectifier 58. When the transistor is on, current flows through the transistor 53 from the output of the diode bridge rectifier 58, which energizes the relay 54. The contacts of relay 54 then allow power to flow to the pump. In that manner the transistor 53 and the relay 54 operate together as an electrically controlled switch. Because the coil of the relay 54 is an inductive load which produces "back EMF" (a high voltage spike which goes both polarities with respect to ground) when it is switched OFF, a diode (D2) 55 is placed in parallel with the coil of the relay to suppresses this spike and protect the transistor (Q1) 53 from high-voltage breakdown and reverse polarity.

A switch 120, which can be, for example, a momentary push button switch, a membrane pushbutton switch, or an air-activated switch (air-switch), is connected to an input of the microcontroller 68. The switch 120 can be operated by a user to indicate when the pump should be turned on or off.

Figure 3:
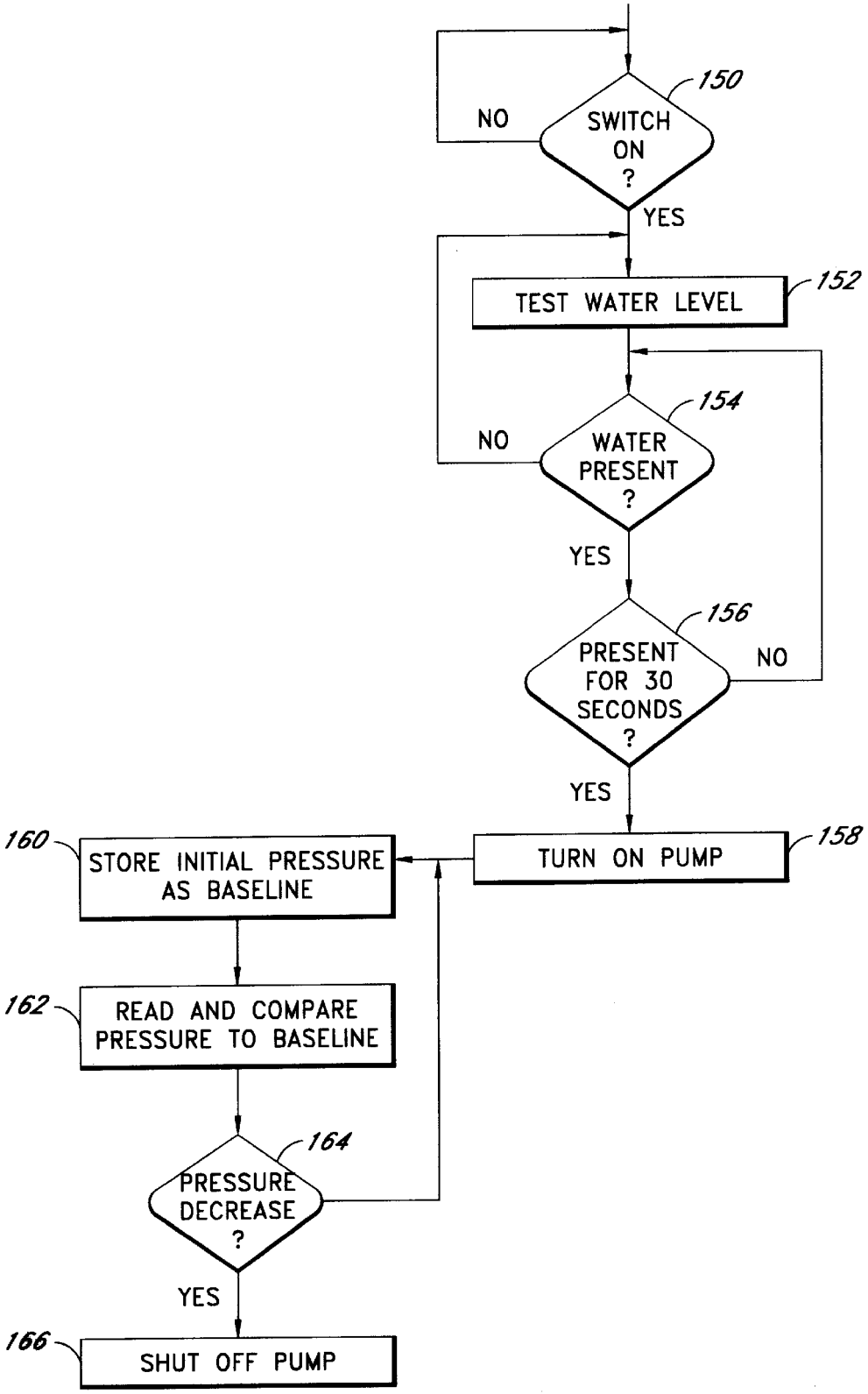
FIG. 3 is a flow diagram of the operation of the circuit of FIG. 2.

Referring now to FIG. 3, operation of the control circuit depicted in FIG. 2 will be described. Operation of the control circuit can be controlled by software or firmware running on the microcontroller 68. The software can be stored on a suitable storage device such as ROM or RAM or other computer memory and can be in the form of a software module.

Starting from a time when the pump is not running, a user can turn the switch 120 on which is then detected by the microcontroller 68 as represented by block 150. If the switch is not on, the microcontroller continues sensing the input from the switch 120, waiting for an indication that the switch is on.

Once the microcontroller senses that the switch was turned on, the control circuit then tests the water level of the spa. The water level is tested by the microprocessor generating a relatively high frequency square wave, which is transmitted from an output of the microprocessor 68 by a resistor 106 in series with a capacitor 104 to one of the two conductive elements 32, 34 in the tub and is represented by block 152. When water covers both of the conductive elements, 32, 34, the square wave generated by the microcontroller will be conducted between the two conductive elements and the signal will be returned by one of the conductive elements via connector 102 and the connector output 102*b*. The returned signal is then provided to the detector circuit 108 which provides a signal to the microcontroller 68. For example, in the embodiment depicted in FIG. 2, the detector circuit 108 will produce a level-shifted sawtooth waveform which is interpreted as a logic HIGH by the microcontroller at pin 14 of the microcontroller. In that manner, the microcontroller can determine if water is present as represented by block 154.

When the detector circuit 108 indicates that the water is present and covers the two conductive elements 32, 34, the control circuit can then further test that the water was not only momentarily present such as might occur when a tub is being initially filled and momentary splashing or wave action may provide conductance between the two conductive elements 32, 34. This can be accomplished by continuing to test whether water is present, after water is first detected, for an additional preselected time period, such as 30 seconds as is represented by block 156.

After a sufficient level of water has been detected, the microcontroller 68 provides the control signal to the transistor (Q1) 53 which allows current to flow through the transistor 53 from the output of the diode bridge 58, which energizes the relay 54. The relay 54 operates as a switch which when turned on applies power to the pump 20 as is represented by Box 158.

When the pump is turned on and begins pushing the water through the spa system, water pressure is increased on the outlet side of 42 of the pump 20 while the pressure level on the inlet side 44 of the pump 20 decreases. A predetermined time after the pump is turned on, such as 2 seconds, the microcontroller acquires the pressure level at that time from the pressure sensor 70, via the differential amplifier 78. The microcontroller 68 stores that initial or first pressure level, for example, in the microcontroller's random access memory (RAM), for use as a baseline for future reference as is represented by block 160. This initial pressure level can be different for each spa system in which the control circuit is utilized. The differences in initial pressure levels can be because of differences between spas, for example in the diameter and length of their plumbing, the horsepower-rating of pump motors, variations in pump design, the amount of the restriction in the jet plumbing, etc.

Storing the baseline pressure level provides an important self-calibration function. This capability allows the control circuit to be used with different pumps, plumbing arrangements, tubs, etc., because the control circuit does not require a preset calibration. In addition, this allows the control circuit to adapt to long-term changes in the overall performance of the spa system such as decreased pump output which can occur as filters become clogged during normal operation.

After the baseline pressure level has been acquired, the microprocessor 68 periodically reads the current pressure level via the pressure sensor 70, for example, two to 500 times per second. The current pressure level is compared to the baseline pressure level previously stored as represented by block 162. Alternatively, the microcontroller can compare any two pressure level readings separated in time. The microcontroller determines whether there has been a decrease in the pressure level below the baseline as represented by block 164. A decrease of or in excess of a predetermined amount, such as a 20% decrease below the stored baseline, can be used as an indication that an entrapment has occurred. A percentage change or an absolute change can be used.

When such a decrease in pressure is detected, the microcontroller immediately shuts off the pump 20 as represented by block 166. The microcontroller shuts off the pump by sending a logic-LOW signal to the transistor 53 which causes the relay 54 to open and thereby turning power off to the pump 20. The microcontroller can also shut off a heater in a similar manner.

In addition to selecting a predetermined decrease in pressure, a time requirement can also be included. The microcontroller can use both the detection of a pressure level in excess of the predetermined decrease level and the duration of the decrease in the pressure for determining when to shut off the pump. For example, the microcontroller can be programmed to ignore decreases in the pressure which have a duration shorter than 0.1 seconds. If the decrease in the pressure does not exceed the predetermined decrease and/or does not exceed a predetermined time interval, the control circuit then continues to regularly read and compare the current vacuum level.

The microcontroller can also be programmed to include a time out feature which automatically shuts off the pump after a predetermined or programmable time period, such as twenty minutes.

Therefore, the control circuit provides a safety feature of turning off the pump upon the detection of entrapment and/or complete or partial blocking of the drain of the spa system. In addition, the control circuit can be utilized with many different pumps, plumbing configurations and types of spas because it is self-calibrating upon start-up. It is therefore very convenient for the retrofitting of older installed spa systems.

Though the foregoing embodiment has been described with regard to detecting changes in pressure (increases in vacuum level) on the inlet side of the pump, the system can also be implemented based upon changes in pressure at the output 42 of pump 20. However, there may be a slight delay between a decrease in pressure on the inlet side of the pump and the corresponding decrease in pressure on the outlet side of the pump. As was note above, various sensors for detecting different measurements or indications which relate to or can be correlated with the pressure in the spa system can also be used. In addition, the foregoing embodiment has been described with regard to controlling a pump. However, the same flow detection and control of a device such as a pump in accordance with the flow detection can also be applied to the control of other spa devices such as a heater and can be used to control multiple devices such as a pump and a heater. Further, the microcontroller can also be used to control other spa features such as lights and cleaners.

The invention may be embodied in other specific forms without departing from its spirit or essential characteristics. The described embodiments are to be considered in all respects only as illustrative and not restrictive. The scope of the invention is indicated by the appended claims rather than by the foregoing description. All changes and variations which come within the meaning and range of equivalency of the claims are to be embraced within their scope.

What is claimed is:

1. A spa control circuit for use with a spa system having a pump for circulating water through the spa system, the circuit comprising:

at least one pressure sensor capable of producing a signal representative of changes in pressure in the spa system;

a microcontroller coupled to receive the signal from the pressure sensor, programmed to store a first pressure, compare the first pressure with a subsequent pressure and generate a control signal when the comparison indicates a change in pressure which exceeds a predetermined amount;

an electrically controlled switch coupled to receive the control signal from the microcontroller and capable of controlling application of electrical power to the pump in response to the control signal.

2. The control circuit of claim 1, wherein said switch comprises a relay.

3. The control circuit of claim 1, wherein said pressure sensor comprises a strain/gage bridge device.

4. The control circuit of claim 1, wherein said pressure sensor, comprises piezo resistive material.

5. The control circuit of claim 1, further comprising an amplifier coupled to receive the output signal of the pressure sensor.

6. A spa control circuit for use with a spa system having a circulating system including a pump for circulating water through the spa system, the circuit comprising:

at least one sensor capable of producing a signal representative of the pressure generated by the pump;

a microcontroller coupled to receive the signal from the sensor, and configured to store a first level indicative of a signal received from the sensor at a first time, compare the first level with a second level indicative of a signal received from the sensor at a second time and generate a control signal when the comparison indicates a change in pressure which exceeds a predetermined amount of change;

an electrically controlled switch coupled to receive the control signal from the microcontroller and configured to control application of electrical power to a device in response to the control signal.

7. The control circuit of claim 6, wherein said first switch mechanism comprises a relay.

8. The control circuit of claim 6, wherein said sensor comprises a strain/gage bridge device.

9. The control circuit of claim 6, wherein said sensor comprises a flow meter.

10. A spa system comprising:

a main switch which controls the flow of electrical power to the spa system;

a water pump coupled to the main switch;

a control circuit comprising at least one sensor which produces an electrical signal representative of the pressure generated by the pump, and a microcontroller coupled to receive the signal from the at least one sensor, said microcontroller including a stored program which when executed by the microcontroller causes the microcontroller to store an initial pressure level and generate a control signal when a subsequent pressure level varies by a predetermined amount from the initial pressure level; and a switch mechanism responsive to said control signal which controls the application of electrical power to the pump in response thereto.

11. The spa system of claim 10, further including a heater.

12. The spa system of claim 10, wherein said switch mechanism comprises a relay.

13. The spa system of claim 10, wherein said sensor comprises a strain/gage bridge device.

14. The control circuit of claim 10, wherein said sensor comprises a flow meter.

15. A method for controlling the flow of electrical power to a device in a spa system, comprising:

supplying electrical power to a pump of the spa system;

storing a first pressure level representative of the pressure generated by the pump at a first time;

comparing the first pressure level with a second pressure level representative of the pressure generated by the pump at a time subsequent to the first time; and stopping the flow of electrical power to the pump if the comparison indicates a change in pressure which exceeds a predetermined amount of change.

16. The method of claim 15, further comprising repeatedly measuring the second level indicative of a signal received from the sensor at a second time and comparing the second level to the first level.

17. The method of claim 15, further comprising determining if sufficient water is present in the spa system.

18. A safety circuit for a spa having a circulating system including a pump, the circuit comprising:

a power source; and an entrapment sensor circuit comprising a pressure sensing element which responds to the pressure in said circulating system, and a circuit interrupter, connected in series between said power source and said pump, which disconnects said power source from said pump when the pressure in said circulating system of said spa heater changes more than a predetermined amount from an initial pressure.

* * * * *